US012178244B2

(12) United States Patent
Zhou et al.

(10) Patent No.: US 12,178,244 B2
(45) Date of Patent: Dec. 31, 2024

(54) ELECTRONIC ATOMIZING DEVICE

(71) Applicant: SHENZHEN SMOORE TECHNOLOGY LIMITED, Shenzhen (CN)

(72) Inventors: Weidong Zhou, Shenzhen (CN); Xiaoan Zhu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 597 days.

(21) Appl. No.: 16/746,998

(22) Filed: Jan. 20, 2020

(65) Prior Publication Data

US 2020/0236995 A1 Jul. 30, 2020

(30) Foreign Application Priority Data

Jan. 25, 2019 (CN) ..... 201920148450.3

(51) Int. Cl.

| | |
|---|---|
| ***A24F 40/40*** | (2020.01) |
| ***A24F 40/10*** | (2020.01) |
| ***A24F 40/485*** | (2020.01) |
| ***A24F 40/51*** | (2020.01) |

(52) U.S. Cl.

CPC ..... *A24F 40/40* (2020.01); *A24F 40/10* (2020.01); *A24F 40/51* (2020.01); *A24F 40/485* (2020.01)

(58) Field of Classification Search

CPC ..... A24F 40/10; A24F 40/40; A24F 40/485; A24F 40/51

See application file for complete search history.

(56) References Cited

U.S. PATENT DOCUMENTS

| | | | | |
|---|---|---|---|---|
| 2016/0270442 | A1* | 9/2016 | Liu | A24F 40/485 |
| 2020/0178612 | A1* | 6/2020 | Zhu | A24F 40/10 |
| 2021/0274846 | A1* | 9/2021 | Potter | A24F 40/485 |

FOREIGN PATENT DOCUMENTS

| | | |
|---|---|---|
| CN | 203723439 | 7/2014 |
| CN | 108523246 | 9/2018 |
| CN | 109043676 | 12/2018 |
| WO | 2020002924 | 1/2020 |

OTHER PUBLICATIONS

"Search Report of Europe Counterpart Application", issued on Jul. 2, 2020, p. 1-p. 11.
"Search Report of Europe Counterpart Application", issued on Jul. 20, 2020, p. 1-p. 11.
"Office Action of Europe Related Application, Application No. 20152783.5", issued on Oct. 21, 2022, p. 1-p. 7.

* cited by examiner

*Primary Examiner* — Russell E Sparks
(74) *Attorney, Agent, or Firm* — JCIP GLOBAL INC.

(57) ABSTRACT

The present invention relates to an electronic atomizing device including an atomizing assembly and a puff sensor electrically connected with the atomizing assembly. An air passage fluidly connected to the atomizing assembly and a starting passage fluidly connected between the airflow passage and the puff sensor are defined in the electronic atomizing device. The starting passage defines a receiving groove for receiving a condensed aerosol. The condensed aerosol is received by the receiving groove when flowing into the starting passage, and is prevented from flowing into a main body to cause damage to elements such as the power supply, the puff sensor and a PCB therein, thereby extending the service life of the main body.

16 Claims, 3 Drawing Sheets

ELECTRONIC ATOMIZING DEVICE

CROSS REFERENCE TO RELATED APPLICATION

The present invention is based upon and claims the benefit of priority from the prior Chinese Patent Application No. 201920148450.3 filed on Jan. 25, 2019; the entirety of the above-mentioned patent application is hereby incorporated by reference herein and made a part of this specification.

TECHNICAL FIELD

The present invention relates to the technical field of atomization, and specifically to an electronic atomizing device.

BACKGROUND

An electronic atomizing device mainly includes an atomizer and a main body. The main body supplies power to the atomizer to enable an atomizing assembly in the atomizer to generate heat, so that a liquid stored in the atomizer can be atomized into an aerosol.

Typically, an air passage is defined in the atomizer for fluidly communicating an outer atmosphere with a nozzle, so that the aerosol generated by the atomizing assembly can be drawn into a mouth of a user via the airflow passage. Conventially, the main body in a refillable or rechargeable electronic atomizing device is reusable, therefore has a certain requirement on service life.

However, the aerosol in the airflow passage may condense after stopping heating. The condensed aerosol may permeate into the main body, and thus causes damage to the main body, as well as reduction in service life of the main body.

SUMMARY

The technical problem to be solved by the present invention is to provide an electronic atomizing device capable of receiving a condensed aerosol.

The technical solution adopted by the present invention to solve the technical problem is to construct an electronic atomizing device including an atomizing assembly and a puff sensor electrically connected with the atomizing assembly; wherein an air passage fluidly connected to the atomizing assembly and a starting passage fluidly connected between the airflow passage and the puff sensor are defined in the electronic atomizing device; and the starting passage defines a receiving groove for receiving a condensed aerosol.

Preferably, the airflow passage includes an air inlet passage fluidly connected between the atomizing assembly and an air inlet, and the starting passage is fluidly connected to the air inlet passage.

Preferably, the starting passage includes a first section and a second section; the first section extends from the airflow passage in a direction away from a nozzle, the second section and the first section are arranged at an angle, and the receiving groove is defined on one side of the second section which is away from the nozzle.

Preferably, the electronic atomizing device includes an atomizer and a main body; a liquid storage cavity is defined in the atomizer, and the atomizing assembly is disposed in the atomizer; the main body includes a mounting bracket and a mounting base; the puff sensor is disposed in the mounting base, and the mounting base is disposed on the mounting bracket; one end of the mounting bracket is connected with the atomizer, and the first section is defined at one end of the mounting bracket which is proximate to the atomizer; and the mounting base is disposed at one end of the first section which is away from the atomizer; the mounting base defines an inlet opening to allow an air to enter the puff sensor, and the starting passage is fluidly connected to the inlet opening.

Preferably, the receiving groove is defined in the mounting base, and the nozzle is disposed at one end of the atomizer which is away from the main body.

Preferably, the mounting bracket defines a receiving cavity which is fluidly connected to the starting passage and the inlet opening and is capable of receiving a liquid that flows in.

Preferably, the receiving cavity is defined on one side of the mounting bracket which faces the inlet opening, and a maximum distance from the receiving cavity to the atomizer is larger than a maximum distance from the inlet opening to the atomizer.

Preferably, a flange extending into the airflow passage is provided circumferentially around a periphery of an end portion of the starting passage which is fluidly connected with the airflow passage.

Preferably, the main body further includes a power supply disposed on the mounting bracket; the mounting bracket isolates the power supply from the atomizer, and the power supply is electrically connected with the puff sensor.

Preferably, the electronic atomizing device further includes a casing sleeved outside the main body and the atomizer; a periphery of an end portion of the mounting bracket which is opposite to the atomizer is in a sealed connection with an inner wall of the casing.

The electronic atomizing device of the present invention has the following beneficial effects: the receiving groove for receiving a condensed aerosol is defined in the starting passage, so that the condensed aerosol is received by the receiving groove when flowing into the starting passage, and is prevented from flowing into the main body to cause damage to elements such as the power supply, the puff sensor and a PCB therein, thereby extending the service life of the main body.

To make the aforementioned more comprehensible, several embodiments accompanied with drawings are described in detail as follows.

BRIEF DESCRIPTION OF THE DRAWINGS

The present invention will now be further described with reference to the accompanying drawings and embodiments.

DETAILED DESCRIPTION

In order to render a more apparent understanding of technical features, objects, and effects of the present invention, specific embodiments thereof will be described in detail with reference to the accompanying drawings.

Figure 1:
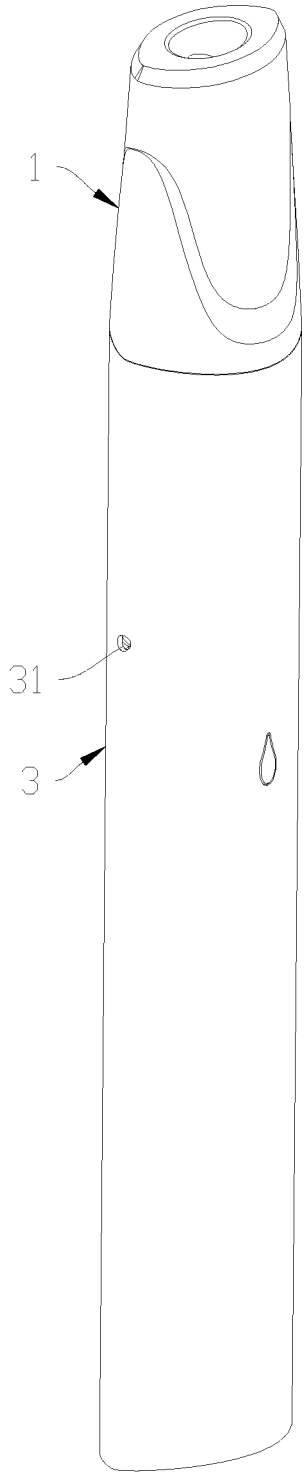
FIG. 1 is a schematic structural diagram of an electronic atomizing device according to an embodiment of the present invention.
Figure 2:
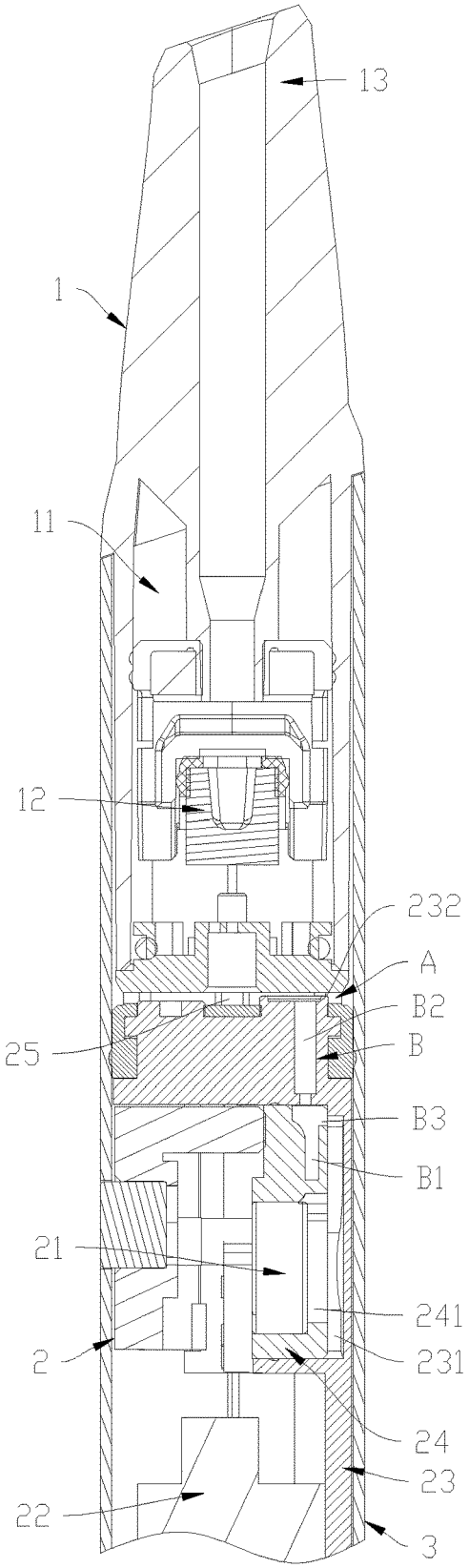
FIG. 2 is a cross-sectional diagram of the electronic atomizing device of FIG. 1.
Figure 3:
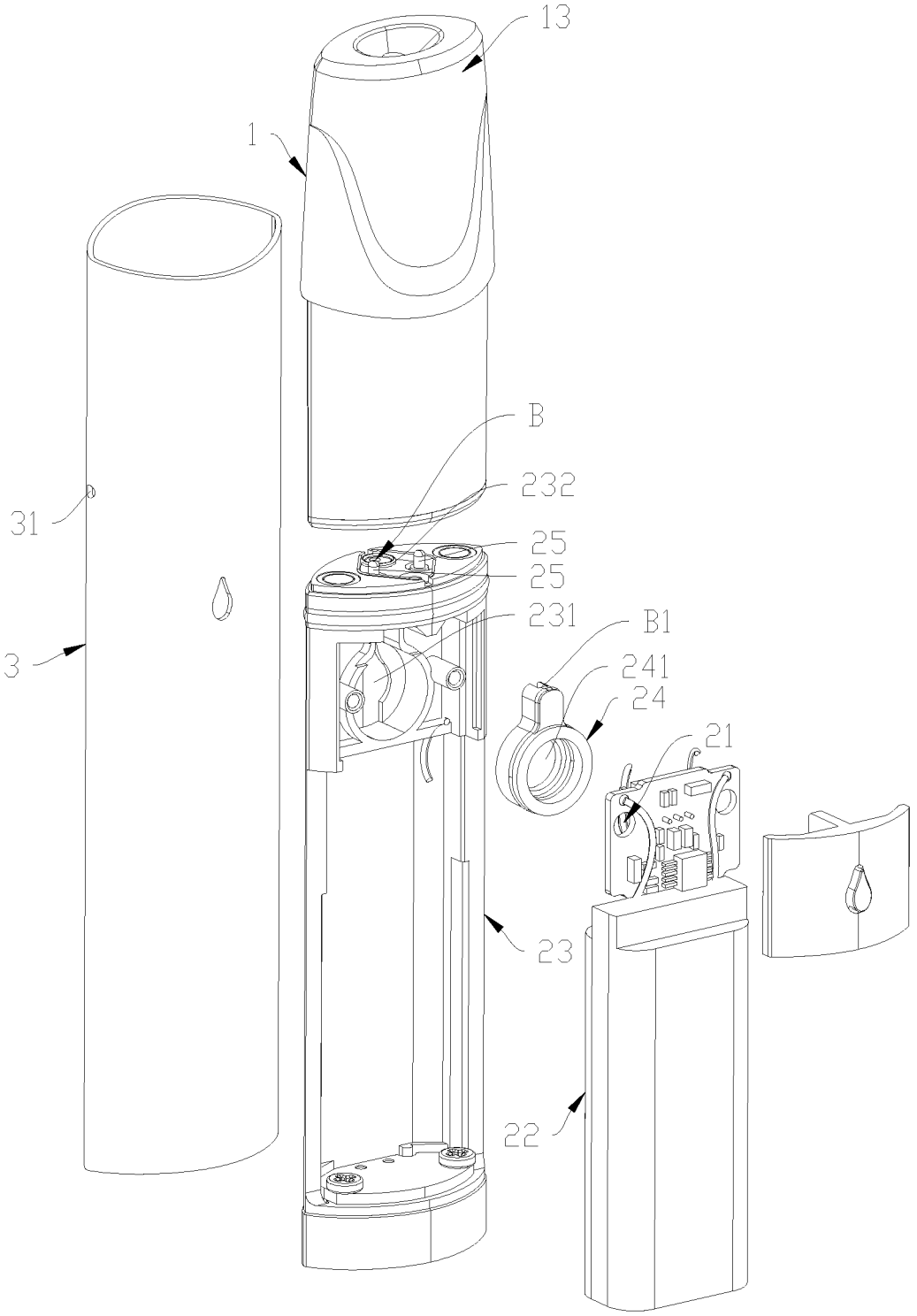
FIG. 3 is an exploded diagram of the electronic atomizing device of FIG. 1.

As shown in FIG. 1 to FIG. 3, an electronic atomizing device in a preferred embodiment of the present invention includes an atomizer 1 and a main body 2 which are connected with each other. A liquid storage cavity 11 is defined in the atomizer 1. An atomizing assembly 12 is disposed in the atomizer 1, and a liquid in the liquid storage cavity 11 can flow to the atomizing assembly 12 to be adsorbed.

The main body 2 includes a puff sensor 21 and a power supply 22. The puff sensor 21 and the power supply 22 are electrically connected with the atomizing assembly 12. The main body 2 supplies power to the atomizing assembly 12 of the atomizer 1. The atomizing assembly 12 heats and atomizes the adsorbed liquid into an aerosol when electrified.

An air passage A fluidly connected to the atomizing assembly 12 and a starting passage B fluidly connected between the airflow passage A and the puff sensor 21 are defined in the electronic atomizing device. Generally, the puff sensor 21 may be a microphone sensor. In other embodiments, the puff sensor 21 may be another type of airflow sensor.

When a user draws, an air enters the airflow passage A via the air inlet 31 and flows into the starting passage B. The puff sensor 21 senses the air flowing, and controls the power supply 22 to supply power to the atomizing assembly 12.

The atomizing assembly 12 heats and atomizes the liquid into the aerosol. Then the aerosol is carried by the air flowing in the airflow passage A to the nozzle 13, to be drawn by the user.

Preferably, the starting passage B defines a receiving groove B1 for receiving the condensed aerosol. Therefore, the condensed aerosol is received by the receiving groove B1 when flowing into the starting passage B, and is prevented from flowing into the main body 2 to cause damage to elements such as the power supply 2, the puff sensor 22 and a PCB therein, thereby extending the service life of the main body 2.

In this embodiment, the airflow passage A includes an air inlet passage fluidly connected between the atomizing assembly 12 and an air inlet 31. The starting passage B is fluidly connected to the air inlet passage, so that the air enters the starting passage B before entering the atomizing assembly 12. In other embodiments, the starting passage B may be fluidly connected to an air outlet passage which is fluidly connected between the atomizing assembly 12 and the nozzle 13.

Preferably, the starting passage B includes a first section B2 and a second section B3. The first section B2 extends from the airflow passage A in a direction away from the nozzle 13. The second section B3 and the first section B2 are arranged at an angle. The receiving groove B1 is defined on one side of the second section B3 which is away from the nozzle 13.

The condensed aerosol entering the starting passage B will flow to the receiving groove B1 under an action of gravity during the flowing process, and will not flow to the puff sensor 21 via the second section B3, so that the condensed aerosol is prevented from entering the puff sensor 21.

In some embodiments, the main body 2 includes a mounting bracket 23 and a mounting base 24. The puff sensor 21 is disposed in the mounting base 24, and the mounting base 24 is disposed on the mounting bracket 23.

One end of the mounting bracket 23 is connected with the atomizer 1. An end of the mounting bracket 23 which is adjacent to the atomizer 1 serves as a sealing end to isolate the puff sensor 21 and the power supply 22 from the atomizer 1, so that the air can only enter the puff sensor 21 via the starting passage B.

The power supply 22 is disposed on the mounting bracket 23. The end portion of the mounting bracket 23 which is adjacent to the atomizer 1 isolates the power supply 22 from the atomizer 1. The power supply 22 is electrically connected with the puff sensor 21.

The end portion of the mounting bracket 23 which is adjacent to the atomizer 1 is provided with structures such as elastic electrodes 25 to electrically connect the power supply 22 and the puff sensor 21 with the atomizing assembly 12, whereby electrode holes are avoided at the end portion of the mounting bracket 23 which is adjacent to the atomizer 1. Thus, the liquid cannot flow to the power supply 22 and the puff sensor 21 via the electrode holes.

In some embodiments, the electronic atomizing device further includes a casing 3 which is sleeved outside the main body 2 and the atomizer 1. A periphery of an end portion of the mounting bracket 23 which is opposite to the atomizer 1 is in a sealed connection with an inner wall of the casing 3.

Furthermore, the air inlet 31 is defined on a side wall of the casing 3. A space or passage is defined between adjacent ends of the main body 2 and the atomizer 1, to allow the air to flow to the atomizing assembly 12 sequentially through the air inlet 31 and the space or passage between the main body 2 and the atomizer 1.

Preferably, the first section B2 is defined at one end of the mounting bracket 23 which is proximate to the atomizer 1. The first section B extends from the end surface of the mounting bracket 23 proximate to the atomizer 1 in a direction away from the atomizer 1.

In some embodiments, the mounting base 24 is disposed at one end of the first section B2 which is away from the atomizer 1. The second section B3 is defined when the mounting base 24 and the mounting bracket 23 are assembled, thus the processing difficulty of the second section B3 can be reduced. The mounting base 24 defines an inlet opening 241 to allow the air to enter the puff sensor 21. The starting passage B is fluidly connected to the inlet opening 241.

Furthermore, the receiving groove B1 is defined in the mounting base 24. The nozzle 13 is disposed at one end of the atomizer 1 which is away from the main body 2. The opening of the receiving groove B1 is upward when the user draws, and is able to receive the condensed aerosol and avoid the leakage of the condensed aerosol.

In some embodiments, the mounting bracket 23 defines a receiving cavity 231, to prevent the condensed aerosol from overflowing from the receiving groove B1 to the inlet opening 241. The receiving cavity 231 is fluidly connected to the starting passage B and the inlet opening 241, and is capable of receiving the liquid that flows in. The condensed aerosol overflowing from the receiving groove B1 can be received again by the receiving cavity 231, to avoid further flowing to the inlet opening 241. Thus the service life of the main body 2 is further extended.

The receiving cavity 231 is defined on one side of the mounting bracket 23 which faces the inlet opening 241. A maximum distance from the receiving cavity 231 to the atomizer 1 is larger than a maximum distance from the inlet opening 241 to the atomizer 1. Thus the receiving cavity 231 is capable of receiving the condensed aerosol, and preventing the condensed aerosol from flowing to the puff sensor 21 via the inlet opening 241.

A flange 232 extending into the airflow passage A is provided circumferentially around a periphery of an end portion of the starting passage B which is fluidly connected with the airflow passage A. Thus the difficulty of flowing into the starting passage B of the condensed aerosol in the airflow passage A is increased, and the condensed aerosol that enters the main body 2 is reduced. Preferably, the flange 232 is disposed at one side of the mounting bracket 23 which is adjacent to the atomizer 1.

It is to be understood that the above-mentioned technical features can be used in any combination without limitation.

The above description is merely exemplary of the present invention, and is not intended to limit the scope of the present invention; the equivalent structure or equivalent process transformation on the basis of the present invention and of the drawings may be directly or indirectly applied to other related technical fields and shall all fall within the scope of the present invention.

What is claimed is:

1. An electronic atomizing device, comprising an atomizing assembly and a puff sensor electrically connected with the atomizing assembly; wherein, an air passage fluidly connected to the atomizing assembly and a starting passage fluidly connected between the air passage and the puff sensor are defined in the electronic atomizing device; and the starting passage communicates with a receiving groove for receiving a condensed aerosol, wherein the starting passage comprises a first section and a second section, the first section extends from the air passage in a direction away from a nozzle, the second section and the first section are arranged at an angle, and the receiving groove is defined on one side of the second section which is away from the nozzle, the electronic atomizing device comprises an atomizer and a main body, a liquid storage cavity is defined in the atomizer, and the atomizing assembly is disposed in the atomizer;

the main body comprises a mounting bracket and a mounting base, the puff sensor is disposed in the mounting base, and the mounting base is disposed on the mounting bracket; and, one end of the mounting bracket is connected with the atomizer, and the first section is defined at another one end of the mounting bracket which is proximate to the atomizer; and the mounting base is disposed at one end of the first section which is away from the atomizer; the mounting base defines an inlet opening to allow an air to enter the puff sensor, and the starting passage is fluidly connected to the inlet opening, the receiving groove is formed on the mounting base, the receiving groove and the nozzle are located at two opposite sides of the first section, the second section is not connected to the puff sensor through the first section, and the second section is perpendicular to the first section, the first section and the second section are located in the main body.

2. The electronic atomizing device according to claim 1, wherein the air passage comprises an air inlet passage fluidly connected between the atomizing assembly and an air inlet, and the starting passage is fluidly connected to the air inlet passage.

3. The electronic atomizing device according to claim 1, wherein the nozzle is disposed at one end of the atomizer which is away from the main body.

4. The electronic atomizing device according to claim 1, wherein the mounting bracket defines a receiving cavity which is fluidly connected to the starting passage and the inlet opening and is capable of receiving a liquid that flows in.

5. The electronic atomizing device according to claim 4, wherein the receiving cavity is defined on one side of the mounting bracket which faces the inlet opening, and a maximum distance from the receiving cavity to the atomizer is larger than a maximum distance from the inlet opening to the atomizer.

6. The electronic atomizing device according to claim 1, wherein a flange extending into the air passage is provided circumferentially around a periphery of an end portion of the starting passage which is fluidly connected with the air passage.

7. The electronic atomizing device according to claim 2, wherein a flange extending into the air passage is provided circumferentially around a periphery of an end portion of the starting passage which is fluidly connected with the air passage.

8. The electronic atomizing device according to claim 3, wherein a flange extending into the air passage is provided circumferentially around a periphery of an end portion of the starting passage which is fluidly connected with the air passage.

9. The electronic atomizing device according to claim 4, wherein a flange extending into the air passage is provided circumferentially around a periphery of an end portion of the starting passage which is fluidly connected with the air passage.

10. The electronic atomizing device according to claim 5, wherein a flange extending into the air passage is provided circumferentially around a periphery of an end portion of the starting passage which is fluidly connected with the air passage.

11. The electronic atomizing device according to claim 1, wherein the main body further comprises a power supply disposed on the mounting bracket; the mounting bracket isolates the power supply from the atomizer, and the power supply is electrically connected with the puff sensor.

12. The electronic atomizing device according to claim 11, wherein the electronic atomizing device further comprises a casing sleeved outside the main body and the atomizer, a periphery of an end portion of the mounting bracket which is opposite to the atomizer is in a sealed connection with an inner wall of the casing.

13. The electronic atomizing device according to claim 3, wherein the main body further comprises a power supply disposed on the mounting bracket; the mounting bracket isolates the power supply from the atomizer, and the power supply is electrically connected with the puff sensor.

14. The electronic atomizing device according to claim 13, wherein the electronic atomizing device further comprises a casing sleeved outside the main body and the atomizer, a periphery of an end portion of the mounting bracket which is opposite to the atomizer is in a sealed connection with an inner wall of the casing.

15. The electronic atomizing device according to claim 4, wherein the main body further comprises a power supply disposed on the mounting bracket; the mounting bracket isolates the power supply from the atomizer, and the power supply is electrically connected with the puff sensor.

16. The electronic atomizing device according to claim 15, wherein the electronic atomizing device further comprises a casing sleeved outside the main body and the atomizer, a periphery of an end portion of the mounting bracket which is opposite to the atomizer is in a sealed connection with an inner wall of the casing.

* * * * *